US006035795A

United States Patent [19]

Dhellemmes et al.

[11] Patent Number: 6,035,795

[45] Date of Patent: Mar. 14, 2000

[54] IMPERMEABLE AND THERMALLY INSULATING TANK COMPRISING PREFABRICATED PANELS

[75] Inventors: Jacques Dhellemmes, Versailles; Pierre Jean, Dampierre, both of France

[73] Assignee: Gaz Transport et Technigaz, Trappes, France

[21] Appl. No.: 09/345,948

[22] Filed: Jul. 1, 1999

[30] Foreign Application Priority Data

Jul. 24, 1998 [FR] France ..... 98 09486
Jun. 9, 1999 [FR] France ..... 99 07254

[51] Int. Cl.[7] ..... B63B 25/08

[52] U.S. Cl. ..... 114/74 A; 220/901

[58] Field of Search ..... 114/69, 74 R, 114/74 A; 220/901, 902

[56] References Cited

U.S. PATENT DOCUMENTS

| | | | |
|---|---|---|---|
| 4,128,069 | 12/1978 | Kotcharian | 114/74 A |
| 4,128,187 | 12/1978 | Okamoto et al. | 114/74 A |
| 5,269,247 | 12/1993 | Jean | 114/74 A |
| 5,450,806 | 9/1995 | Jean | 114/74 A |
| 5,586,513 | 12/1996 | Jean et al. | 114/74 A |

FOREIGN PATENT DOCUMENTS 0 543 686 A1 5/1993 European Pat. Off. .

2 724 623 3/1996 France .

*Primary Examiner*—Stephen Avila

*Attorney, Agent, or Firm*—Pollock, Vande Sande & Amernick

[57] ABSTRACT

Impermeable and insulating tank built into a load-bearing structure, the tank having two successive sealing barriers alternated with two thermally insulating barriers, the secondary barriers and the primary insulating barrier consisting of a set of prefabricated panels, each panel comprising, in succession, a first rigid board, a first thermal insulation layer (104), a second thermal insulation layer (108), and a second rigid board, the junction regions between the primary insulating barrier elements of two adjacent panels being filled with insulating titles each consisting of a thermal insulation layer (115) covered with a rigid board, the continuity of the secondary sealing barrier being provided in the junction regions of two adjacent panels by flexible strips (120) which are impervious to gas and to liquid, each strip being hermetically bonded to a secondary insulating barrier element of a panel by a lateral marginal region (120*a*) and to a secondary insulating barrier element of the adjacent panel by an opposite lateral marginal region (120*b*), so that its central region (120*c*), which covers the junction region, is free to deform elastically and/or elongate with respect to the insulating tiles.

20 Claims, 4 Drawing Sheets

102
106
104
103
109
121
118
150
137
120
115
116
114
110
149
111
148
1
108

134
130
112
133
135
136
137a

IMPERMEABLE AND THERMALLY INSULATING TANK COMPRISING PREFABRICATED PANELS

The present invention relates to the construction of impermeable and thermally insulating tanks built into a load-bearing structure, especially the hull of a ship intended for transporting liquefied gas by sea and, in particular, for transporting liquefied natural gas having a high methane content.

French Patent Application No. 2,724,623 has proposed an impermeable and insulating tank built into a load-bearing structure, especially a ship, the said tank having two successive sealing barriers, one a primary barrier in contact with the product contained in the tank and the other a secondary barrier placed between the primary barrier and the load-bearing structure, these two sealing barriers being alternated with two thermally insulating barriers, the primary sealing barrier consisting of metal strakes with edges turned up toward the inside of the tank, the said strakes being made of thin sheet metal with a low expansion coefficient and being welded edge to edge, by their turned-up edges, to the two faces of a weld support which is held mechanically against the primary insulating barrier and constitutes a sliding joint, in which tank the secondary barriers and the primary Insulating barrier essentially consist of a set of prefabricated panels which are fastened to the load-bearing structure, each panel being formed, firstly, by a first rigid board supporting a thermal insulation layer and constituting with the latter a secondary Insulating barrier element, secondly, by a flexible web adhering to approximately the entire surface of thermal insulation layer of the aforementioned secondary insulating barrier elements, the said web consisting of a composite material the two outer layers of which are fiber-glass fabrics and the intermediate layer of which is a deformable thin aluminum sheet 0.1 mm in thickness, the said sheet forming a secondary sealing barrier element, thirdly, by a second thermal insulation layer which at least partially covers the aforementioned web and which adheres to it and, fourthly, by a second rigid board covering the second thermal insulation layer and constituting with the latter the primary insulating barrier, the junction regions of two adjacent panels being filled so as to at least ensure continuity of the secondary sealing barrier. The flexibility of the aluminum sheet, because of its small thickness, allows it to follow the deformations of the panels due to the deformation of the hull owing to the swell of the sea or to the refrigeration of the tank.

This known tank structure makes it possible:

on the one hand, to use a thin primary insulating barrier comprising a rigid board providing good resistance to the impacts produced on the walls of the tank by the movements of the liquid being transported, the small thickness of this insulating barrier having the advantage that, should there be a leak in the primary sealing barrier, the accidental cold region is further away from the double hull the thicker the secondary insulating barrier;

and, on the other hand, to considerably reduce the cost price of such a tank by using prefabricated panels which allow, in a single operation, for two secondary barriers and the primary insulating barrier of the tank to be fitted—by adopting such a structure, an approximately 25%, reduction in the manufacturing cost may be obtained.

Furthermore, in order to ensure sealing continuity of the secondary sealing barrier, provision is made, in line with the joints between panels, for the adjacent peripheral rims of two adjacent panels to be covered with a strip of flexible web having at least one continuous thin metal sheet, the said strip adhering to the two adjacent peripheral rims and, because of its metal sheet, ensuring continuity in the sealing. To ensure continuity of the primary insulating barrier, provision is made for the peripheral region existing between the primary insulating barrier elements of two adjacent panels to be filled by means of insulating tiles, each of which consists of a thermal insulation layer covered with a rigid board, each tile being bonded to the strip of flexible web on its insulation layer side and having the thickness of the primary insulating barrier, so that, after assembly, the boards of the insulating tiles and the second rigid boards of the panels constitute an approximately continuous wall capable of supporting the primary sealing barrier.

It is known that, when the ship moves in the swell, the deformation of the beam, which constitutes it, generates very large tensile stresses in the primary and secondary sealing barriers, which stresses in fact are added to the tensile stresses generated in these sealing barriers during the refrigeration of the In the tank structure described in French Patent Application No. 2,724,623, the primary sealing barrier, which consists of Invar strakes, transmits a tensile stress generated by thermal contraction, of the order of 10 tons per linear meter, to the connection rings in the corners of the tank and to the transverse bulkheads of the load-bearing structure, whereas the secondary sealing barrier, which consists of the flexible web, transmits only a tensile stress of the order of 5 tons per linear meter. This difference between the stresses generated in the primary and secondary sealing barriers can cause problems in the joints between the panels, which in turn weakens the continuity of the secondary sealing barrier.

In French Patent Application No. 2,691,520, the junction regions between the insulating layers of the secondary insulation barrier are covered with a strip which is interposed and bonded between the secondary insulating layers and the primary insulating layers. The secondary sealing barrier is obtained by hermetically fastening together the secondary insulating layers, the plugs for closing off the wells and the joints made of thermally insulating material which are inserted between the adjacent panels, so that the secondary insulating layer forms, after it has been assembled and bonded, a continuous and therefore completely impermeable secondary barrier. Given that it is the secondary insulating layer which guarantees good confinement of the fluid inside the structure should there be a crack in the primary sealing barrier, the strips for covering the junction regions are neither impermeable nor hermetically fastened to the secondary insulating layers. The main function of these covering strips is to keep the insulating tiles of the primary insulating barrier joined to the secondary insulating layers. For this purpose, the covering strip is a fiber-glass fabric or the like. One of the faces of the said covering strip is bonded, in a definitive manner, to the insulating tiles and its other face is bonded to the secondary insulating layers. Furthermore, in this French Patent Application No. 2,691,520, the panels are bonded to the load-bearing structure of the tank by a plurality of bearing pads.

The object of the invention is to propose an Impermeable and thermally insulating tank, the secondary barriers and the primary insulating barrier of which consist of a set of prefabricated panels which are improved so as to avoid the problems due to stress Concentrations in the joint regions between the panels.

For this purpose, the subject of the present invention is an impermeable and insulating tank built into a load-bearing structure, especially a ship, the said tank having two successive sealing barriers, one a primary barrier in contact with the product contained in the tank and the other a secondary barrier placed between the primary barrier and the load-bearing structure, these two sealing barriers being alternated with two thermally insulating barriers, the primary sealing barrier consisting of thin metal sheets held mechanically against the primary insulating barrier, the secondary barriers and the primary insulating barrier essentially consisting of a set of prefabricated panels which are mechanically fastened to the load-bearing structure but not adhesively bonded to it, each panel comprising, in succession, a first rigid board forming the bottom of the panel, a first thermal insulation layer supported by the said bottom board and constituting with the latter a secondary insulating barrier element, a second thermal insulation layer, which partially covers the first aforementioned layer, and a second rigid board forming the cover of the panel and covering the second thermal insulation layer which constitutes with the said second board a primary insulation barrier element, the junction regions between the primary insulating barrier elements of two adjacent panels being filled with insulating tiles each consisting of a thermal insulation layer covered with a rigid board, the rigid boards of the insulating tiles and the second rigid boards of the panels constituting an approximately continuous wall capable of supporting the primary sealing barrier, the junction regions between the secondary insulating barrier elements being filled by means of a joint made of thermally insulating material, characterized in that the continuity of the secondary sealing barrier is provided in the junction regions of two adjacent panels by flexible strips which are impervious to gas and to liquid and may include at least one deformable continuous thin metal sheet, each strip being hermetically bonded, on its side facing the secondary insulating barrier, on the one hand, to a secondary insulating barrier element of one panel by a lateral marginal region of the said strip and, on the other hand, to a secondary insulating barrier element of the adjacent panel by an opposite lateral marginal region of the said strip so that the central region of the said strip, which covers the junction region Between the two aforementioned secondary insulating barrier elements is free to deform elastically and/or to elongate with respect to the insulating tiles (overlying) and to the insulating joint (underlying), the panels being held against the walls of the load-bearing structure with a limited freedom of movement in the planes parallel to the said walls. The acceptable elongation of the flexible junction strips makes it possible to eliminate or very significantly reduce the traction and tensile stresses exerted by the secondary sealing barrier on the load-bearing bulkheads under the effect of the deformation of the hull due to swell, due to the refrigeration of the tank or to movements of the cargo.

Advantageously, a prefabricated panel is fastened to the load-bearing structure using fastening means uniformly distributed around the perimeter of the secondary insulating barrier element, the said fastening means being stud bolts which are welded so as to be, approximately perpendicular to the load-bearing structure, the said stud bolts each having their free end threaded, the relative arrangement of the panels and of the stud bolts being made so that the stud bolts are in line with the perimeter of the secondary insulating barrier element, a well being provided, in line with each stud bolt, through the first thermal insulation layer, the bottom of the well consisting of the first rigid board of the panel and having a hole which allows passage for a stud bolt, an axially elastically deformable means being fitted onto the stud bolt in order to bear on the bottom of the well and being held in place by a nut screwed onto the stud bolt, the said elastically deformable means allowing a certain movement of the panels in a direction perpendicular to the load-bearing structure. For example, the axially elastically deformable means consists of at least one frustoconical metal washer through which a stud bolt passes, the said washer being inserted between the bottom of a well and the associated nut.

Preferably, the first thermal insulation layer of a panel is an unreinforced cellular foam, especially polyurethane foam, having, for example, a density of approximately 105 $kg/m^3$, while the second thermal insulation layer of the said panel is made of a reinforced cellular foam, for example reinforced with glass fibers, with, for example, a density of approximately 120 $kg/m^3$.

As a variant, the first and second thermal insulation layers of a panel are made of an unreinforced cellular foam, especially polyurethane foam, for example with a density of approximately 105 $kg/m^3$.

In one particular embodiment of the invention, each panel has the general shape of a rectangular parallelepiped, the first rigid board and the first thermal insulation layer having, seen in plan view, the shape of a first rectangle, the second thermal insulation layer and the second rigid board having, seen in plan view, the shape of a second rectangle, the two rectangles having their sides approximately parallel, the length and the width of the second rectangle being respectively less than the length and the width of the first rectangle, a peripheral rim thus being provided on each panel around the primary insulation barrier element of the said panel so that the said marginal regions of each strip are hermetically bonded to the said peripheral rims of the panels; it should be understood that the abovementioned rectangular shape of the first and second rigid boards and thermal insulation layers which correspond to them includes the square shape; provision may be made for the two rectangles which define, seen in plan view, the primary and secondary insulating barrier elements of any one panel to have approximately the same center, the peripheral rim of the said panel then having an approximately constant width.

In a first variant, the aforementioned wells emerge on the said peripheral rims of the panels so that the said strips cover the wells with their marginal bonding regions in order to close off the wells.

In a second variant, the aforementioned wells emerge on the said peripheral rims of the panels so that the said strips cover the wells with their nonbonded central region, without closing off the wells.

It is clear that, at each well, when the panels are joined to the load-bearing structure there is no longer any continuity in the secondary insulating barrier; provision is therefore made, to ensure continuity of the secondary insulation barrier, for each well, after a panel has been fastened to the load-bearing structure, to be filled by means of a plug of thermally insulating material.

Advantageously, the central region of each strip has a width greater than that of the junction region between the adjacent secondary insulating barrier elements.

In one particular embodiment, the rigid boards of the insulating tiles and the second rigid boards of the panels are joined together by metal fasteners which straddle the tiles and the panels.

In another embodiment, the insulating tiles have a longitudinal groove on their opposite side walls and the panels have a corresponding longitudinal groove 0n the opposite side walls of their primary insulating barrier elements, so as to join the tiles to the panels by keys placed discontinuously along the panels, each key extending from a tile groove to a panel groove.

According to another characteristic, the insulating tiles are temporarily held either against the flexible strip by removable spots of adhesive, before the primary sealing barrier is fitted, or laterally against one of the adjacent panels by spots of adhesive.

In a known manner, in one particular embodiment, since the primary sealing barrier consists of metal strakes with edges turned up toward the inside of the tank, the said strakes being made of sheet metal with a low expansion coefficient and being welded edge to edge, by their turned-up edges, to the two faces of a weld support, which is held mechanically against the primary insulating barrier and constitutes a sliding joint, and [sic] the weld support associated with the metal strakes of the primary sealing barrier is advantageously an angle section, one of the legs of the angle section being welded to the turned-up edges of two adjacent metal strakes of the primary sealing barrier, while the other leg is engaged in a groove made in the thickness of the second rigid board of a panel; according to an advantageous arrangement, each second rigid board of a panel has two parallel grooves, each receiving a weld support, the central regions of the second rigid boards of two adjacent panels each being covered with a strake of the primary sealing barrier while another strake of the same width forms the junction between the two aforementioned strakes.

According to one embodiment, the flexible strip, which ensures continuity of the secondary sealing barrier in each junction region between two adjacent panels, consists of three layers, the two outermost layers being fiber-glass fabrics while the intermediate layer is a metal sheet; advantageously, the metal sheet may be an aluminum sheet having a thickness of approximately 0.1 mm.

The second thermal insulation layer of the panels advantageously consists of a cellular plastic, such as a polyurethane foam reinforced with glass fibers using mats, cloths, fabrics, yarns or the like; this second layer may include, parallel to its large faces, a plurality of fiber-glass fabrics forming approximately parallel sheets; in these layers, the sheets may be equidistant, but it is also possible for the sheets to be placed with a spacing which is smaller the lower the service temperature in the relevant region of the layer, in order to ensure optimum reinforcement in the region where the mechanical stresses due to the refrigeration of the tank are greatest. Provision may be made, in a known manner, for each panel to bear against the load-bearing structure via curable resin elements allowing compensation for the imperfections in the walls of the load-bearing structure so that, independently of the local deformations of the said load-bearing structure, it is possible to obtain, thanks to the second boards of the panels and to the boards of the insulating tiles fitted in line with the peripheral rims of the panels, a uniform continuous surface constituting a satisfactory bearing surface for the metal sheets of the primary sealing barrier, the said resin elements not adhering to the load-bearing structure, for example by interposing a sheet of paper.

In a known manner, the corner join of the primary and secondary barriers, in the regions where the walls of the load-bearing structure are joined together so as to make an angle, is made in the form of a joining ring, the structure of which remains approximately constant over the entire length of the intersection edge of the walls of the load-bearing structure.

In a first embodiment, a continuous metal sheet made of thin sheet metal having a low expansion coefficient, is inserted between the first and second thermal insulation layers of the panels, the said sheet adhering to approximately the entire surface of the first thermal insulation layer so as to form a secondary sealing barrier element, the second thermal insulation layer adhering approximately over its entire surface to the said sheet.

In a second embodiment, a flexible web, which is impervious to gas and to liquid and may include a continuous deformable thin aluminum sheet, is inserted between the first and second thermal insulation layers of the panels, the said web adhering to approximately the entire surface of the first thermal insulation layer, so as to form a secondary sealing barrier element, the second thermal insulation layer adhering approximately over its entire surface to the said web.

In a third embodiment, the secondary sealing barrier consists, on the one hand, of the first thermal insulation layer of the panels, which is made of a closed-cell foam, and, on the other hand, of the said flexible strips.

In order to make the subject of the invention more clearly understood, a description will now be given, purely by way of illustration and implying no limitation, of two of its embodiments shown in the appended drawing. In this drawing.

Figure 6:
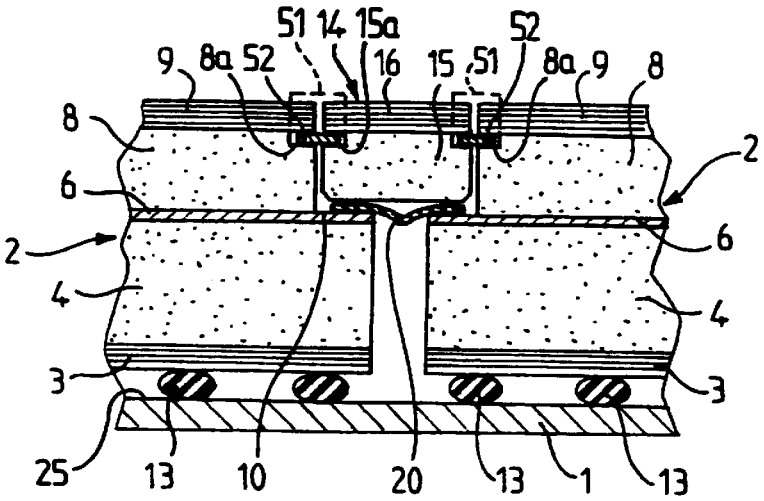
FIG. 6 is a partial cross-sectional view illustrating the junction region between two adjacent panels.

Referring to the first embodiment, illustrated in FIGS. 1 to 7, and more particularly to FIG. 6, the reference number 1 denotes the wall of the ship's double hull, in which the tank according to the invention that has just been described is installed. It is known that a ship's hull also includes transverse bulkheads which divide the hull into compartments, these bulkheads also being double-walled. The walls 1 and the bulkheads constitute the load-bearing structure of the tank described. The walls each carry stud bolts which are welded perpendicularly to them, the free end of which stud bolts is threaded. The stud bolts are arranged in lines parallel to the edge formed by the intersection of the walls 1 with the transverse bulkheads.

The two secondary barriers and the primary insulation barrier are formed by means of panels denoted in their entirety by 2. A panel 2 has approximately the shape of a rectangular parallelepiped ; it consists of a 9 mm thick first plywood board 3 surmounted by a first thermal insulation layer 4 which is itself surmounted by a first fiber-glass fabric 5; placed on the fabric 5 is a 0.4 mm thick Invar sheet 6 which is itself partially covered with a second fiber-glass fabric 7; bonded to this second fabric using a polyurethane adhesive is a second thermal insulation layer 8 which itself supports a 12 mm thick second plywood board 9. The subassembly 7 to 9 constitutes a primary insulation barrier element which has, seen in plan view, a rectangular shape, the sides of which are parallel to those of the subassembly 3 to 6; the two subassemblies have, seen in plan view, the shape of two rectangles having the same center, a peripheral rim 10, of constant length, existing all around the subassembly 7 to 9 and consisting of the border of the subassembly 3 to 6. The subassembly 3 to 5 constitutes a secondary insulation barrier element. The sheet 6, which covers this subassembly 3 to 5, constitutes a secondary sealing barrier element.

The panel 2, which has just been described, may be prefabricated in order to constitute an assembly whose various constituents are bonded to each other in the arrangement indicated above; this assembly therefore forms the secondary barriers and the primary insulation barrier. Thermal insulation layers 4 and 8 may be made of a cellular plastic, such as a polyurethane foam to which good mechanical properties have been given, by inserting glass fibers into the foam in order to reinforce it. In French Patent Application No. 2,724,623, which is incorporated here as reference, it is preferred, for making these thermal insulation layers, to place the fiber-glass fabrics in the thickness of the layer so that they form sheets parallel to the large faces of the layers 4 and 8, i.e. parallel to the large faces of the panel 2. A spacing between these sheets may decrease the closer they are to the inside of the tank, in which the temperature is approximately −160° C. In a variant, the sheets may have a constant spacing over the entire thickness of the layer. Of course, it is possible to use one technique for the first layer of a panel and another technique for the second layer.

In order to fasten the panels 2 to the load-bearing structure, wells 11 are provided which are uniformly distributed over the two longitudinal edges of the panel, the said wells 11, which are recesses with a U-shaped cross section, being made in the peripheral rim 10 through the sheet 6, the fabric 5 and the insulation layer 4 as far as the plywood board 3; the bottom of a well 11 therefore consists of the first rigid board 3 of the panel 2; the bottom of the well 11 is drilled in order to form a hole 12 whose diameter is sufficient to allow a stud bolt to pass through it; the stud bolts and the holes 12 are arranged in such a way that if a panel 2 is brought so as to face the wall 1 or a bulkhead of the load-bearing structure, the said panel can be positioned with respect to the wall so that a stud bolt lies opposite each hole 12. The wells 11 are open along the longitudinal walls of the subassembly 4 to 6.

It is known that the walls 1 and the bulkheads of a ship exhibit deviations from theoretical surface provided for the load-bearing structure simply because or manufacturing imprecisions. In a known manner, these deviations may be compensated for by making the panels 2 bear against the load-bearing structure via elongate beads of curable resin 13 which make it possible, starting with an imperfect load-bearing structure surface, to obtain a lining consisting of adjacent panels 2 having second boards 9 which, in their entirety, define a surface which hardly deviates from the desired theoretical surface. For this purpose, a sheet of paper 25 is inserted between the elongate beads 13 and the wall 1 in order to prevent the panels from being bonded to the load-bearing structure.

When the panels 2 are thus presented against the load-bearing structure with the interposition of the elongate resin beads 13, the stud bolts enter the holes 12 and a bearing washer and a lock nut are fitted onto the threaded end of the stud bolts. The washer is applied by the nut against the first rigid board 3 of the panel 2, at the bottom of the well 11. In this way, each panel 2 is fastened against the load-bearing structure by a plurality of points distributed around the periphery of the panel, this being favorable from the mechanical standpoint.

When such fastening has been carried out, the wells 11 are plugged up by inserting plugs of thermally insulating material into them, these plugs being flush with the level of the first thermal insulation layer 4 of the panel. Furthermore, it is possible to fit, in the joint regions which separate the subassemblies (3 to 5) of two adjacent panels 2, a thermal insulation material consisting, for example, of a sheet of plastic foam folded back on itself in the form of a U and forcibly inserted into the joint region. Nevertheless, although the continuity of the secondary insulation barrier has thus been reconstituted, the same does not apply in the case of the continuity of the secondary sealing barrier formed by the sheet 6, since the latter has been perforated in line with each well 11. In order to reconstitute the continuity of the secondary sealing barrier, a flexible strip 20 is fitted over the peripheral rim 10 existing between two subassemblies 7 to 9 of two adjacent panels 2 and the strip 20 is bonded to the peripheral rims 10 so as to close off the perforations located in line with each well 11 and the joints between panels, thereby reconstituting the continuity of the secondary sealing barrier. The secondary flexible strip 20 is made of a composite material comprising three layers—the two outermost layers are fiber-glass fabrics and the intermediate layer is a thin metal sheet, for example an aluminum sheet approximately 0.1 mm in thickness. This metal sheet ensures continuity of the secondary sealing barrier; its flexibility, because of its thickness, allows it to follow the deformations of the panels 2 due to the deformation of the hull owing to the swell or to the refrigeration of the tank.

Between the subassemblies (7 to 9) of two adjacent panels 2, there therefore remains a depression region located in line with the peripheral rims 10, this depression having, as depth, approximately the thickness of the primary insulation barrier (7 to 9). These depression regions are filled by fitting insulating tiles 14 into them, each insulating tile consisting of a thermal insulation layer 15 and of a rigid plywood board 16. The size of the insulating tiles 14 is such that they completely fill the region located above the peripheral rims 10 of two adjacent panels 2; these insulating tiles are simply placed with their layer 15 side on the strips 20 so that, after they have been fitted, their board 16 provides continuity between the boards 9 of two adjacent panels 2. These insulating tiles 14, the width of which is set by the distance between two subassemblies 7 to 9 of two adjacent panels, may be of greater or lesser length, but it is preferred for the length to be short so that, if required, they can be fitted easily, even should there be a slight misalignment between two adjacent panels 2. It is essential for the tiles 14 not to be fastened to the strip 20 in order to allow this strip to deform. On the other hand, they may be bonded by nonadherent resin beads to the strip 20, for example by inserting a sheet of paper.

In FIG. 6, it may be seen that the fasteners 51, shown as broken lines, are fastened astride the top of the board 16 and of the boards 9 in order to join the tiles to the panels.

As a variant, grooves 8*a* and 15*a* may be provided in the insulating layers 8 and 15, opposite each other, in order to house linking keys 52. These grooves run along the side walls of the panels and of the tiles, above the insulating layers, at the interface with the upper boards 9, 16. These grooves also serve for guiding specific manufacturing tools.

Thus, by fitting the panels 2 against the load-bearing structure, the secondary insulation barrier, the secondary sealing barrier and the primary insulation barrier are formed in one go. It is clear that the amount of labor required to fit these three barriers is, consequently, considerably less than in the constructions of the prior art. Of course, the prefabricated panels 2 may be mass produced in a factory, thereby further improving the economic aspect of this construction.

An approximately continuous face consisting of the rigid boards 9 and 16 of the panels 2 and of the insulating tiles 14 has thus been produced. It remains to fit the primary sealing barrier which will be supported by these rigid boards. To do this, grooves 17 have been provided in the boards 9 during manufacture of the panels 2, the said grooves 17 having a cross section in the form of an upside-down T, the stem of the T being perpendicular to the face of the board 9, which faces the inside of the tank, and the two arms of the T being parallel to the said face. Fitted into these grooves 17 is a weld support consisting of an L-shaped angle section 18, the long side of the L being welded to the turned-up edges 19*a* of two adjacent metal strakes 19 of the primary sealing barrier, while the short side of the L is engaged in that part of the groove 17 which is parallel to the midplane of the board 9. In a known manner, the strakes 19 consist of 0.7 mm thick Invar sheets. The weld support 18 can slide inside the groove 17 so that a sliding joint has thus been formed which allows relative movement of the strakes 19 of the primary sealing barrier with respect to the rigid boards 9 and 16 which support it. Each board 9 of a panel 2 has two parallel grooves 17 spaced apart by the width of a strake and lying symmetrically with respect to the longitudinal axis of the panel 2. The Size of the panels 2 is such that the distance between two adjacent weld flanges 18, fitted into two adjacent panels 2, is equal to the width of a strake 19; it is thus possible to fit a strake 19 in line with the central region of each board 9 and a strake 19 between the two strakes 19 which cover the central regions of two adjacent panels 2.

It should be pointed out that, according to the invention, the primary sealing barrier is supported by a rigid board, thereby providing good resistance to the impacts due to the movements of the liquid in the tank.

By way of numerical example, it is possible to use panels 2 having a length of 2.970 meters to within 1 mm and a width of 999 mm to within 0.5 mm, the thickness of the secondary insulation barrier being 180 mm and that of the primary insulation barrier being 90 mm. The width of the strakes 19 between two turned-up edges is 500 mm and their length is 1 m.

Figures 1, 2, 3, 4, 5:
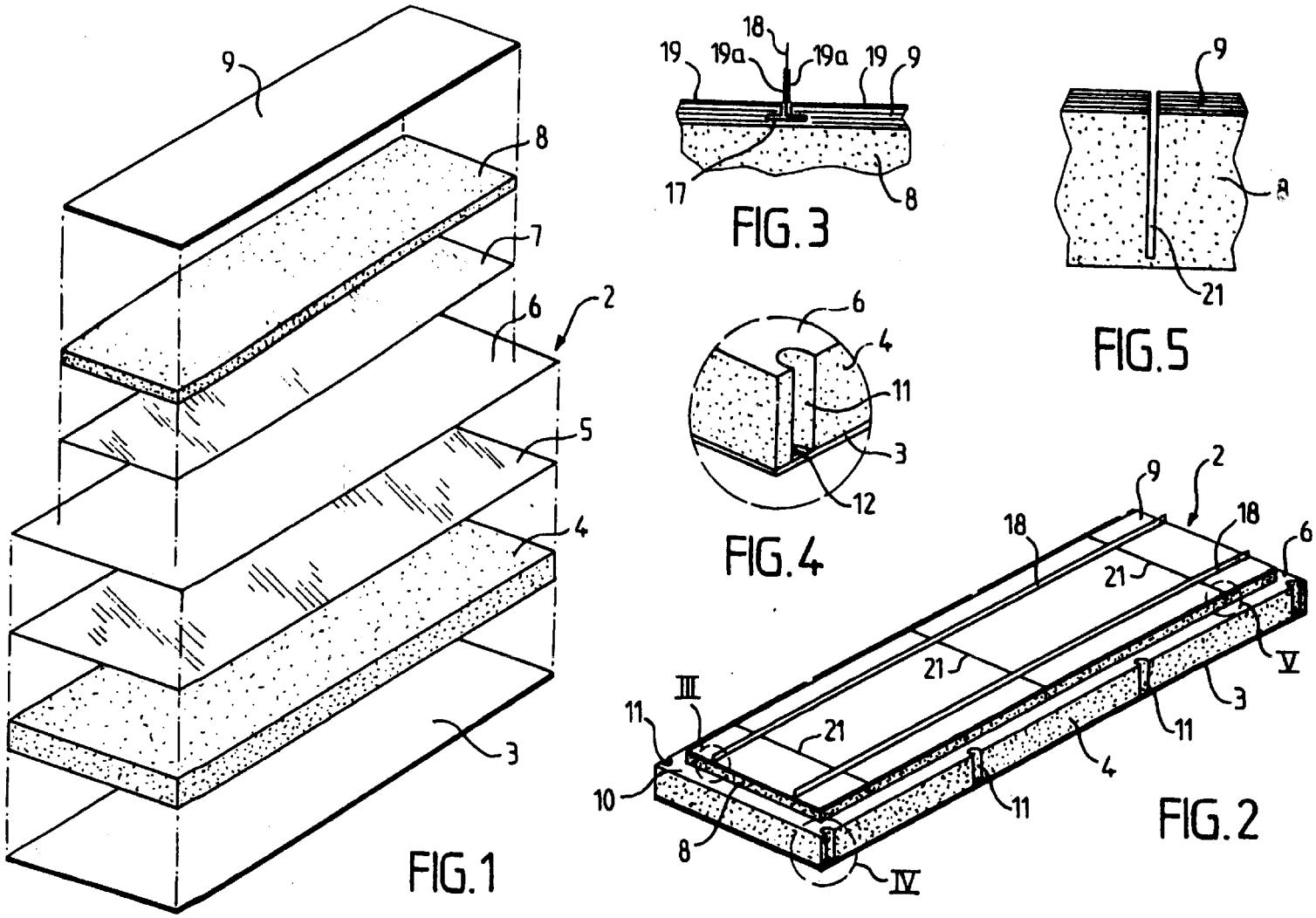
FIG. 1 is an exploded perspective view of a panel of the tank according to a first embodiment of the invention.
FIG. 2 is a perspective view of the panel in FIG. 1, in its prefabricated state, ready to use.
FIGS. 3 to 5 are enlarged views of a detail in FIG. 2 in the direction of the arrows III, IV and V, respectively.

As may be seen in FIGS. 2 and 5, the second thermal insulation layer 8 and the second rigid board 9 are provided with a plurality of slots 21 extending in the transverse direction, i.e. parallel to the short side of the panel 2, the said slots 21 being spaced apart in the longitudinal direction by a distance of approximately 1 m, each slot 21 extending down to approximately 5 mm from the bottom of the second thermal insulation layer 8 and having a width of less than 4 mm. Three slots 21 are provided in the panel 2, the intermediate slot being in the center of the panel while the other slots are near the short sides of the board 9. The function of these slots is to prevent the primary insulating barrier from cracking in an uncontrolled manner when refrigerating the tank.

Figure 7:
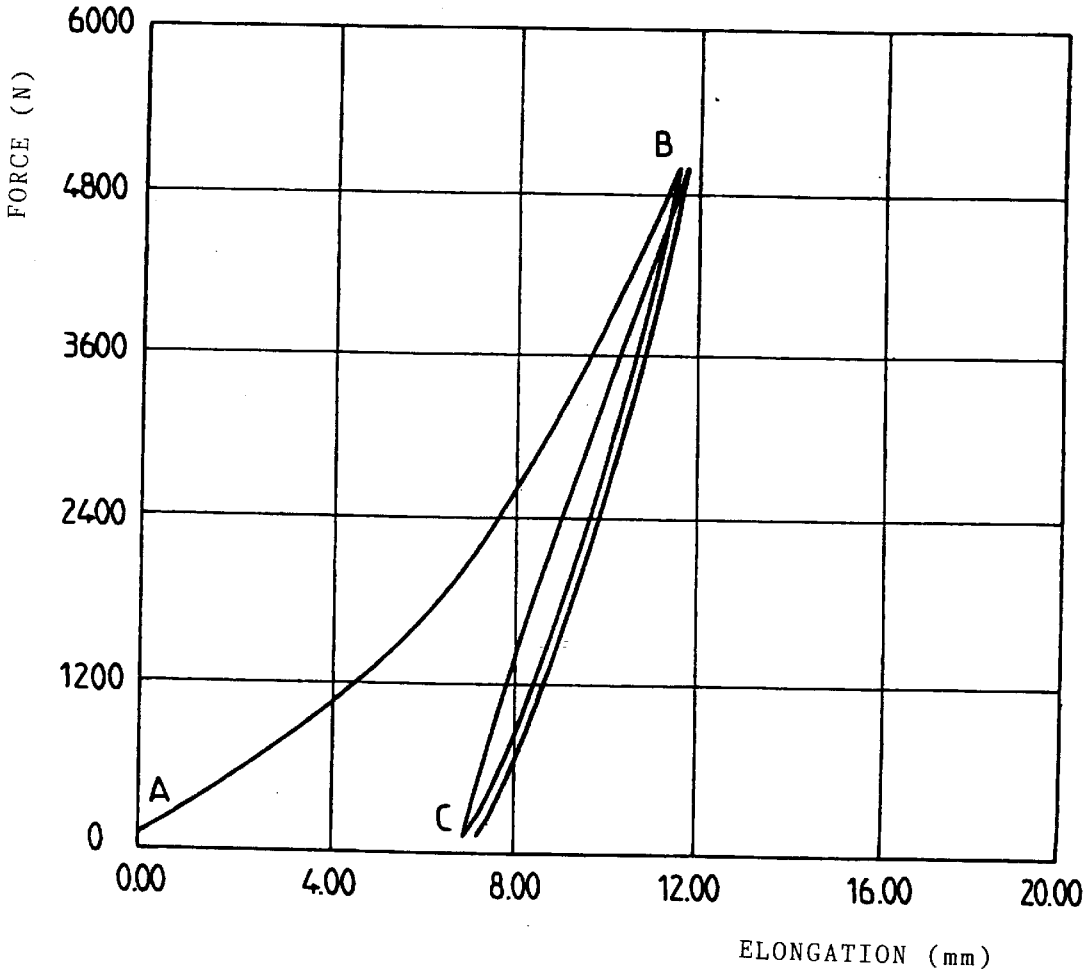
FIG. 7 is a graph showing the curve of elongation of the flexible strip at the junction of two panels as a function of the tensile force.

FIG. 7 shows the curve of elongation of the flexible strip 20 in a tensile test.

Starting from point A, at rest, a tensile force of about 5 kN is exerted on the flexible strip, which results in deformation of the strip, to a point B, at which a large elongation of about 11 mm is observed. If the stress on the strip is then reduced to zero, a reversibility in the deformation of the strip along the line BC is observed, the flexible strip at point C retaining a permanent residual plastic elongation of about 7 mm.

If the flexible strip En its state at point C is reloaded, it is found that, for a tensile force of the same magnitude, the flexible strip deforms reversibly and approximately linearly between points C and B for an elastic elongation of about 4 mm.

Should a tensile force of greater magnitude be exerted on the flexible strip, a plastic elongation of greater value would be expected. Of course, the flexible strip has a tensile strength greater than the maximum stress that it can be subjected to because of the deformations of the hull, the movements of the cargo and the refrigeration of the tank.

Under these conditions, when the flexible strips 20 are subjected to a tensile stress of a given magnitude, they will retain a permanent deformation, as indicated in FIG. 6 by the approximately seagull-wing shape of the flexible strip 20. For subsequent tensile stresses of the same magnitude or of smaller magnitude, the flexible strip 20 will then behave elastically so that the stresses generated by the refrigeration of the tank, by the movements of the cargo and by the swell-induced deformations of the hull will not be transmitted, or only slightly transmitted, by the secondary sealing barrier to the transverse bulkheads.

Referring now to FIGS. 8 to 12, a second embodiment of the tank of the invention will be described. In these figures, identical or similar elements to those in the first embodiment bear the same reference numbers, but increased by about one hundred.

Figure 10:
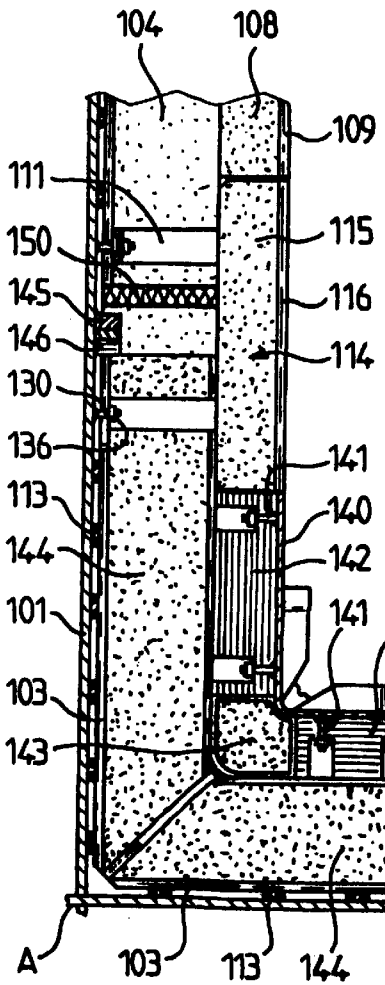
FIG. 10 is a partial longitudinal sectional view of a tank according to the second embodiment of the invention.

In FIG. 10, the primary sealing barrier 119 is formed by thin metal elements such as stainless steel or aluminum sheet. The numerical reference 119*a* denotes transverse and longitudinal ribs projecting from the said sheets, while the reference number 119*b* denotes the overlap join region between two adjacent elements of the primary sealing barrier 119. The ribs 119*a* allow the said primary sealing barrier to be appreciably flexible so as to be able to deform under the effect of the stresses, especially thermal stresses, generated by the fluid stored in the tank.

FIG. 10 shows the internal wall 1 of the ship's double hull and a transverse bulkhead 101 which divides the ship's hull into compartments. The walls 1 and the bulkheads 101 constitute the load-bearing structure of the tank and each carry stud bolts 130 which are soldered perpendicular to the load-bearing structure, the free end of which stud bolts is threaded. The stud bolts 130 are arranged in lines parallel to the edge A formed by the intersection of the walls 1 with the transverse bulkheads 101.

In a known manner, the lower rigid boards 103 of the panels 102 bear against the load-bearing structure via elongate beads of curable resin 113. These elongate beads do not adhere to the double hull by virtue, for example of the interposition of a sheet of paper. Blocks 133, visible in FIG. 9, may also be inserted between the wall 1 and the rigid board 103, one on each side of a stud bolt 130 which passes through the hole 112 in the said board 103. The holes 112 emerge in approximately cylindrical wells 111 extending over the entire height of the first thermal insulation layer 104 of the secondary insulation barrier. At least one elastically deformable frustoconical metal washer 134, for example three so-called Belleville washers, are placed back to back on the threaded end of the stud bolt 130 so that the large base of a first washer 134 bears against the bottom of the well 111 and the small base of the upper washer 134 bears against a plain washer 135. A lock nut 136 clamps the assembly consisting of the plain washer 135 and the conical washers 134 against the bottom of the well 111. Plugs of insulating material 137 are then fitted into the wells 111 in order to ensure continuity in the secondary insulating barrier. These plugs 137 have a recess 137*a* at their base in order for the stud bolt 130, its washers 134 and 135 and its nut 136 to be housed therein. Thus, the stud bolts 130 serve only to retain the panels 102 with respect to the load-bearing structure in a direction perpendicular to the latter, a limited freedom of movement of the panels 102 being possible in the longitudinal and transverse direction [sic] of the tank with respect to the load-bearing structure. Furthermore, the deformable washers 134 also allow the panels 102 to have a degree of movement in a direction perpendicular to the load-bearing structure.

In FIG. 10, it should be noted that, in a defined angle between the wall 1 and the transverse bulkhead 101, the primary insulating barrier has an angle structure consisting of a metal angle section 140 making an angle of approximately 90°, to which angle section the sealing barrier 119 is fastened, the said angle section 140 being fastened by screws 141 to wooden boards 142 having approximately the same thickness as the second thermal insulation layers 108 of the panels 102. Bonded between the two wooden boards 142 is an insulating sheet 143 forming the corner of the primary insulating barrier in the angle. As regards the secondary insulating barrier, this is formed by two sheets of insulating material 144 having a cross section approximately in the form of a right-angled trapezoid in FIG. 10. The sheets 144 are bonded to rigid wooden boards 103. The general shape of the angle structure of the tank illustrated in FIG. 10 is approximately similar to that illustrated and described in Patent Application No. 2,691,520, which is incorporated here as reference. It will therefore not be described in more detail. It should simply be noted that the lower rigid boards 103 are fastened to the load-bearing structure by means of stud bolts 130 and nuts 136, without the interposition of deformable washers 134. Furthermore, the rigid boards 103 of the angle structure also bear on the aforementioned elongate beads of curable resin 113. The angle structure is positioned with respect to the panels 102 by a positioning stop consisting of a metal block 145 welded to the load-bearing structure, and of a block 146 made of plywood or laminated wood, the said block 146 being joined to the said metal block 145 by an Intermediate mastic joint.

Figures 8, 9:
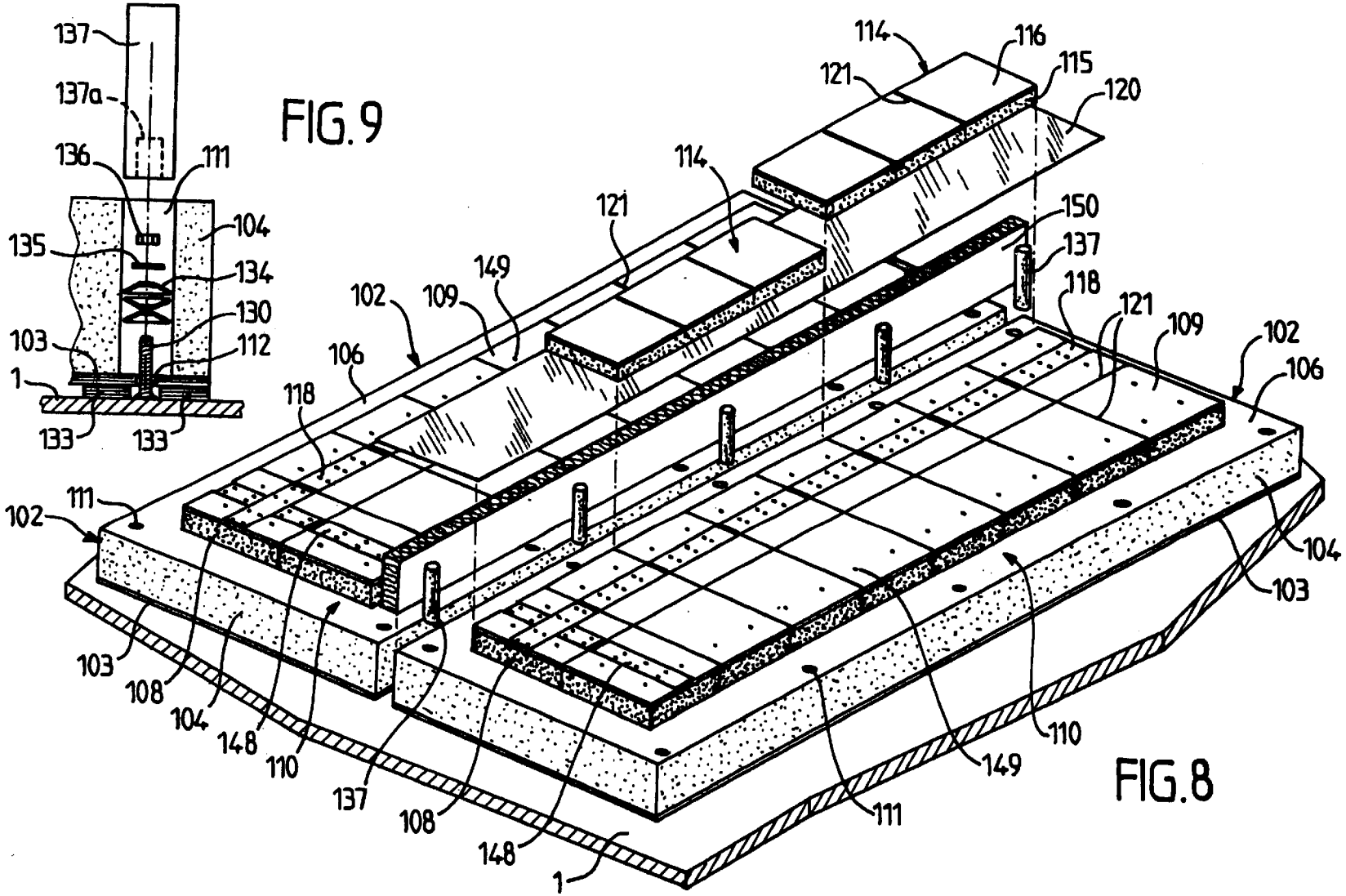
FIG. 8 is a partial perspective view of a second embodiment of the tank of the invention, before the elastically deformable flexible strips have been fitted.
FIG. 9 is an enlarged sectional view of a detail in FIG. 8, showing how a panel is fastened to the load-bearing structure.

As may be more clearly seen in FIG. 8, a stainless metal strip 118 extends longitudinally on the upper rigid board 109 of a panel 102 and a stainless metal strip 148 extends transversely to the said board 109, in order to allow the primary sealing membrane 119 to be anchored to the said boards 109. These anchoring strips 118 and 148 are preferably riveted to the upper board 109 of the panels 102. Furthermore, the upper boards 109 may also include a plurality of metal inserts 149, particularly for allowing the attachment of tools.

Provided in the second thermal insulation layer 108 and in the second rigid board 109 are a plurality of longitudinal and transverse slots 121, the said slots extending down to approximately 5 mm from the bottom of the second thermal insulation layer 108 and having a width of less than 4 mm, so as to prevent the primary insulating barrier from cracking in an uncontrolled manner when refrigerating the tank.

Strips of thermally insulating materials 150, for example glass wool, are inserted into the junction regions between the secondary insulating barrier elements.

Figure 12:
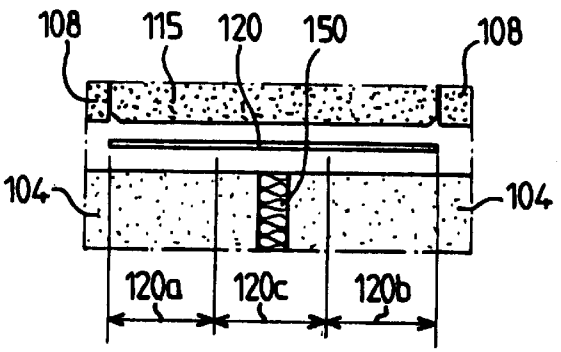
FIG. 12 is an enlarged view of a detail in FIG. 10, showing the region around the deformable flexible strip, in exploded position.

Referring now to FIG. 12, this shows that the flexible strip 120 has, on its lower face, two opposed lateral marginal regions 120*a* and 120*b* which are intended to be bonded to the peripheral rim 110 of two adjacent panels 102, the central region 120*c* of the said strip 120 being intended to cover, without bonding, the plugging material 150 as well as part of the said peripheral rim 110 of each panel. By way of example, the strip 120 may have a width of 270 mm, with a central region 120*c* having a width of 110 mm while the strip of insulating material 150 has a width of only 30 mm. Thus, it is possible to allow elastic deformation and/or elongation of the strip 120 greater than the width of the function region between the secondary insulating barrier elements. This flexible strip 120 preferably has the same length as that of the panels 102.

The reference number 106 in FIG. 8 indicates a metal sheet intended to serve as a secondary sealing barrier element between the two thermal insulation layers 104 and 108 of a panel 102, but this metal sheet 106 could also be dispensed with since the secondary insulating layer 104 is a closed-cell foam which, by itself, ensures the secondary sealing function, as long as the flexible strip 120 properly covers the wells 111 and the joints 150.

It may be seen that the layers of insulating material 108, 115 and 143 of the primary insulating barrier are made of polyurethane foam reinforced with glass fibers, with a density of 120 kg/m$^3$. It should also be noted that the layers of insulating material 144 of the secondary insulating barrier, in the angle structure, are also made of reinforced foam, unlike the layers 104 of the secondary insulating barrier of the panels 102.

The reason for this is that, because of the use of deformable washers 134 at the point where the panels 102 are fastened to the stud bolts 130, the secondary insulating layer 104 of the panels 102 is subjected to lower stresses and can therefore be made without being reinforced with glass fibers.

Figure 11:
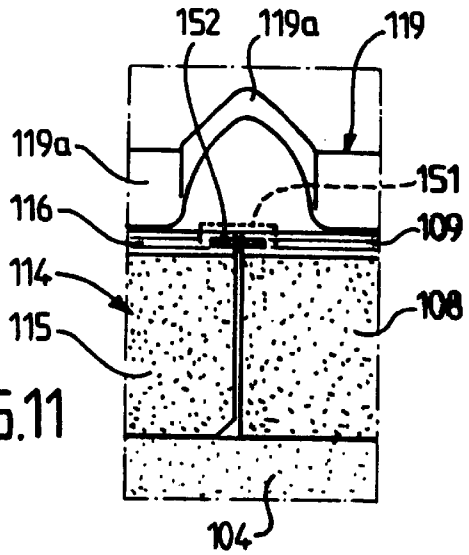
FIG. 11 is an enlarged view of a detail in FIG. 10, as indicated by the arrow XI.

Referring to FIGS. 11 and 12, it may be seen that the insulating tiles 114 are simply laid on the flexible strips 120, without bonding, in order to allow free elastic deformation and/or elongation of the latter, so that it is necessary to fasten the insulating tiles 114 to the primary insulating barrier elements of the panels 102.

In a first variant, fasteners 151, illustrated by the broken lines in FIG. 11, are fastened so as to straddle the top of the rigid board 116 of the insulating tile 114 and of the upper rigid board 109 of the adjacent panel 102.

In another variant, the rigid board 116 of the insulating tile 114 has a longitudinal groove in its thickness, the said groove being open toward the upper rigid board 109 of the adjacent panel 102, which correspondingly has a longitudinal groove, so as to insert a plurality of wooden keys 152 through the said grooves. By way of example, for a tile 340 mm in length, a single key may suffice, whereas, for a tile 480 mm in length, two spaced-apart keys may be inserted into the grooves. Although not shown, the grooves could also be provided throughout the insulating layers 115 and 108, instead of the rigid boards 116 and 109. These grooves also serve for the mechanical guiding of a machine for bonding the flexible strip 120 to the underlying secondary insulating barrier element.

The primary sealing barrier 119, with its transverse and longitudinal ribs 119*a*, forms, inside the tank, a membrane with a corrugated surface.

Although the invention has been described in relation to several particular embodiments, it is quite obvious that it is in no way limited thereby and that it encompasses all technical equivalents of the means described, as well as their combinations, provided these fall within the scope of the invention.

We claim:

1. Impermeable and insulating tank built into a load-bearing structure of a ship, the said tank having two successive sealing barriers, one a primary barrier (19, 119) in contact with the product contained in the tank and the other a secondary barrier (6, 106) placed between the primary barrier and the load-bearing structure (1, 101), these two sealing barriers being alternated with two thermally insulating barriers, the primary sealing barrier consisting of thin metal sheets (19, 119) held mechanically against the primary insulating barrier, the secondary barriers and the primary insulating barrier essentially consisting of a set of prefabricated panels (2, 102) which are mechanically fastened to the load-bearing structure but not adhesively bonded to it, each panel comprising, in succession, a first rigid board (3, 103) forming the bottom of the panel, a first thermal insulation layer (4, 104) supported by the said bottom board and constituting with the latter a secondary insulating barrier element, a second thermal insulation layer (8, 108), which partially covers the first aforementioned layer, and a second rigid board (9, 109) forming the cover of the panel and covering the second thermal insulation layer which constitutes with the said second board a primary insulation barrier element, the junction regions between the primary insulating barrier elements of two adjacent panels being filled with insulating tiles (14, 114) each consisting of a thermal insulation layer (15, 115) covered with a rigid board (16, 116), the rigid boards of the insulating tiles and the second rigid boards of the panels constituting an approximately continuous wall capable of supporting the primary sealing barrier, the junction regions between the secondary insulating barrier elements being filled by means of a joint (150) made of thermally insulating material, characterized in that the continuity of the secondary sealing barrier is provided in the junction regions of two adjacent panels by flexible strips (20, 120) which are impervious to gas and to liquid and may include at least one deformable continuous thin metal sheet, each strip being hermetically bonded, on its side facing the secondary insulating barrier, on the one hand, to a secondary insulating barrier element of one panel by a lateral marginal region (120*a*) of the said strip and, on the other hand, to a secondary insulating barrier element of the adjacent panel by an opposite lateral marginal region (120*b*) of the said strip so that the central region (120*c*) of the said strip, which covers the junction region between the two aforementioned secondary insulating barrier elements is free to deform elastically and/or to elongate with respect to the insulating tiles and to the insulating joint, the panels being held against the walls of the load-bearing structure with a limited freedom of movement in the planes parallel to the said walls.

2. Tank according to claim 1, characterized in that a prefabricated panel (102) is fastened to the load-bearing structure (1, 101) using fastening means uniformly distributed around the perimeter of the secondary insulating barrier element, the said fastening means being stud bolts (130) which are welded so as to be approximately perpendicular to the load-bearing structure, the said stud bolts each having their free end threaded, the relative arrangement of the panels and of the stud bolts being made so that the stud bolts are in line with the perimeter of the secondary insulating barrier element, a well (111) being provided, in line with each stud bolt, through the first thermal insulation layer (104), the bottom of the well consisting of the first rigid board (103) of the panel and having a hole (112) which allows passage for a stud bolt, an axially elastically deformable means (134) being fitted onto the stud bolt in order to bear on the bottom of the well and being held in place by a nut (136) screwed onto the stud bolt, the said elastically deformable means allowing a certain movement of the panels in a direction perpendicular to the load-bearing structure.

3. Tank according to claim 2, characterized in that the axially elastically deformable means consists of at least one frustoconical metal washer (134) through which a stud bolt (130) passes, the said washer being inserted between the bottom of a well (111) and the associated nut (136).

4. Tank according to claim 2, characterized in that the first thermal insulation layer (104) of a panel (102) is an unreinforced cellular foam, especially polyurethane foam, having, for example, a density of approximately 105 kg/m$^3$, while the second thermal insulation layer (108) of the said panel is made of a reinforced cellular foam, for example reinforced with glass fibers, with, for example, a density of approximately 120 kg/m$^3$.

5. Tank according to claim 2, characterized in that the first and second thermal insulation layers (104, 108) of a panel (102) are made of an unreinforced cellular foam, especially polyurethane foam, for example with a density of approximately 105 kg/m$^3$.

6. Tank according to claim 1, characterized in that each panel (2, 102) has the general shape of a rectangular parallelepiped, the first rigid board (3, 103) and the first thermal insulation layer (4, 104) having, seen in plan view, the shape of a first rectangle, the second thermal insulation layer (8, 108) and the second rigid board (9, 109) having, seen in plan view, the shape of a second rectangle, the two rectangles having their sides approximately parallel, the length and the width of the second rectangle being respectively less than the length and the width of the first rectangle, a peripheral rim (10, 110) thus being provided on each panel around the primary insulation barrier element of the said panel so that the said marginal regions (120*a*, 120*b*) of each strip are hermetically bonded to the said peripheral rims of the panels.

7. Tank according to claim 2 taken in combination, characterized in that the aforementioned wells (111) emerge on the said peripheral rims (110) of the panels (102) so that the said strips (120) cover the wells with their marginal bonding regions (120*a*, 120*b*) in order to close off the wells.

8. Tank according to claim 2 taken in combination, characterized in that the aforementioned wells (111) emerge on the said peripheral rims of the panels (110) so that the said strips (120) cover the wells with their nonbonded central region (120*c*), without closing off the wells.

9. Tank according to claim 1, characterized in that the central region (120*c*) of each strip (120) has a width greater than that of the junction region (150) between the adjacent secondary insulating barrier elements.

10. Tank according to claim 1, characterized in that the rigid boards (116) of the insulating tiles (114) and the second rigid boards (109) of the panels (102) are joined together by metal fasteners (151) which straddle the tiles and the panels.

11. Tank according to claim 1, characterized in that the insulating tiles (14, 114) have a longitudinal groove (15*a*) on their opposite side walls and the panels (2, 102) have a corresponding longitudinal groove (8*a*) on the opposite side walls of their primary insulating barrier elements, so as to join the tiles to the panels by keys (52, 152) placed discontinuously along the panels, each key extending from a tile groove to a panel groove.

12. Tank according to claim 1, characterized in that the insulating tiles (14, 114) are temporarily held laterally against one of the adjacent panels by spots of adhesive.

13. Tank according to claim 1, characterized in that the flexible strip (20, 120) consists of three layers, the two outermost layers being fiber-glass fabrics while the intermediate layer consists of the said metal sheet.

14. Tank according to claim 13, characterized in that the metal sheet is an aluminum sheet having a thickness of approximately 0.1 mm.

15. Tank according to claim 1, characterized in that a continuous metal sheet (6) made of thin sheet metal having a low expansion coefficient, is inserted between the first (4) and second (8) thermal insulation layers of the panels (2), the said sheet adhering to approximately the entire surface of the first thermal insulation layer so as to form a secondary sealing barrier element, the second thermal insulation layer adhering approximately over its entire surface to the said sheet.

16. Tank according to claim 1, characterized in that a flexible web (106), which is impervious to gas and to liquid and may include a continuous deformable thin aluminum sheet, is inserted between the first (104) and second (108) thermal insulation layers of the panels (102), the said web adhering to approximately the entire surface of the first thermal insulation layer, so as to form a secondary sealing barrier element, the second thermal insulation layer adhering approximately over its entire surface to the said web.

17. Tank according to claim 1, characterized in that the secondary sealing barrier consists, on the one hand, of the first thermal insulation layer (104) of the panels (102), which is made of a closed-cell foam, and, on the other hand, of the said flexible strips (120).

18. Tank according to claim 1, characterized in that the panels (2, 102) bear against the load-bearing structure (1, 101) via elongate beads of curable resin (13, 113) which make it possible to compensate for the differences between the panels and the imperfect surface of the load-bearing structure, the said elongate beads not adhering to the load-bearing structure, for example by interposing a sheet of paper (25).

19. Tank according to claim 3, characterized in that the first thermal insulation layer of a panel is an unreinforced cellular foam, especially polyurethane foam, having, for example, a density of approximately 105 $kg/m^3$, while the second thermal insulation layer of the said panel is made of a reinforced cellular foam, for example reinforced with glass fibers, with, for example, a density of approximately 120 $kg/m^3$.

20. Tank according to claim 3, characterized in that the first and second thermal insulation layers of a panel are made of an unreinforced cellular foam, especially polyurethane foam, for example with a density of approximately 105 $kg/m^3$.

* * * * *